US005401040A

United States Patent [19]

Grenko

[11] Patent Number: 5,401,040

[45] Date of Patent: Mar. 28, 1995

[54] REVERSIBLE ROLLER SKATE TRUCK AND STEERING MECHANISM

[76] Inventor: Joseph Grenko, 3673 Highway 22 E., Muscatine, Iowa 52761-8301

[21] Appl. No.: 234,340

[22] Filed: Apr. 28, 1994

[51] Int. Cl.[6] ..... A63C 17/02

[52] U.S. Cl. ..... 280/11.28; 280/11.27

[58] Field of Search ..... 280/11.19, 11.26, 11.27, 280/11.28, 7.13, 7.14, 87.042

[56] References Cited

U.S. PATENT DOCUMENTS

| | | | |
|---|---|---|---|
| 10,570 | 3/1885 | Rowlett | 280/11.28 |
| 2,424,072 | 7/1947 | Allred . | |
| 2,430,533 | 11/1947 | Reich . | |
| 2,696,989 | 12/1954 | Kleinman | 280/11.27 |
| 2,985,461 | 5/1961 | Lynn et al. | 280/7.13 |
| 3,235,282 | 2/1966 | Bostick | 280/11.26 X |
| 4,103,917 | 8/1978 | Widolf . | |
| 4,278,264 | 7/1981 | Lenz . | |
| 4,328,627 | 5/1982 | Sanders | 280/7.13 X |
| 4,623,159 | 11/1986 | Grenko . | |

FOREIGN PATENT DOCUMENTS

| | | | |
|---|---|---|---|
| 2520242 | 7/1983 | France | 280/11.26 |

*Primary Examiner*—Brian L. Johnson
*Attorney, Agent, or Firm*—Henderson & Sturm

[57] ABSTRACT

A simplified roller skate with an improved assembly for quickly and efficiently adjusting the turning action of the skate. Front and rear wheel trucks comprising a single piece pedestal and tongue unit which are engaged in sockets formed within a main beam assembly, and are turned by selectively adjustable king pin assemblies. Further, structure for reversing the rear wheel truck is disclosed which reduces the stress and strain imposed on the skater's legs and ankles albeit with a reduction in turning capability.

4 Claims, 3 Drawing Sheets

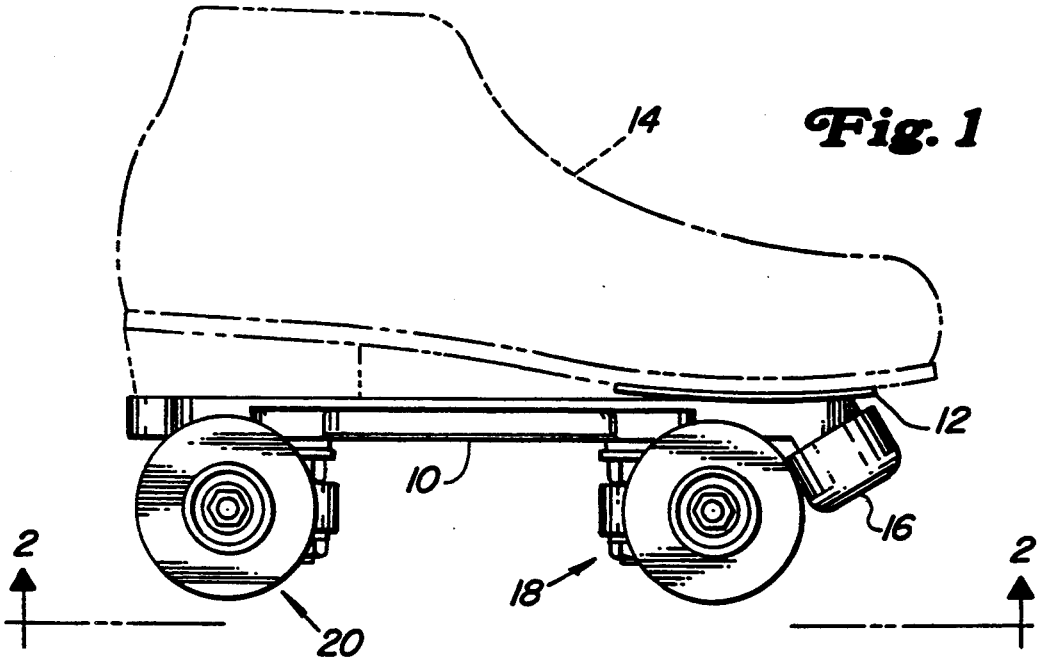
Fig. 1
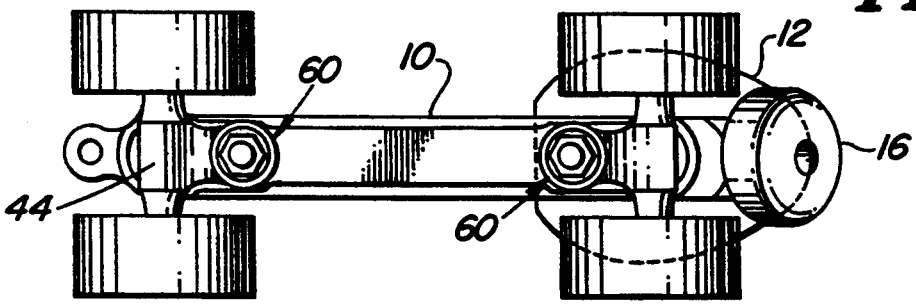
Fig. 2
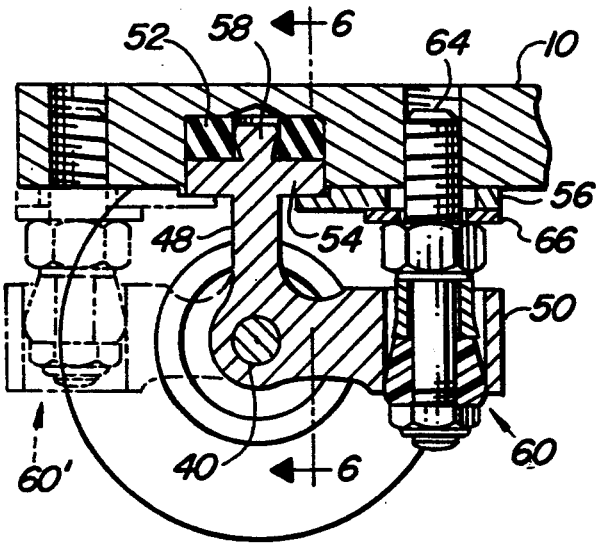
Fig. 5
Fig. 6
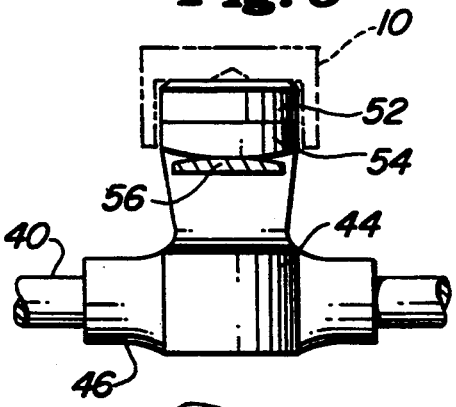
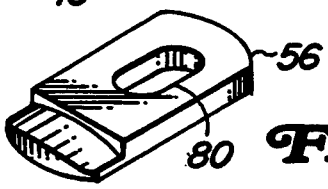
Fig. 7

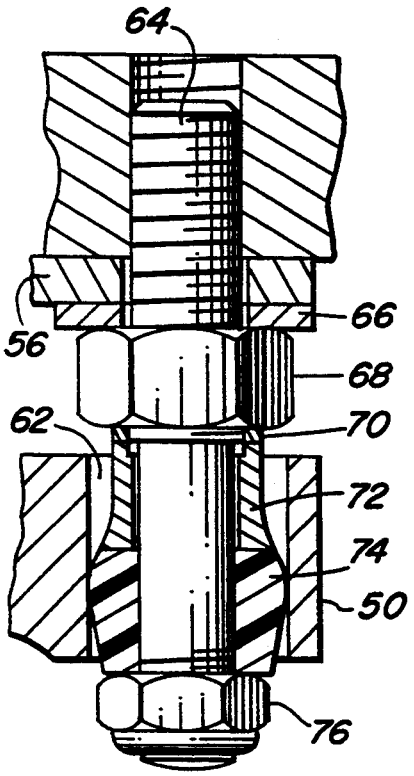
Fig. 8
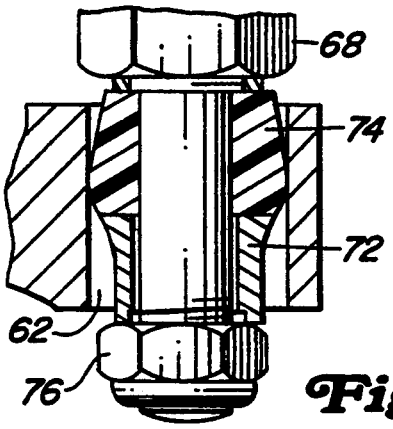
Fig. 9
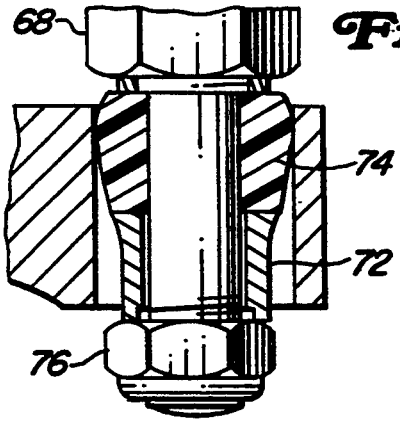
Fig. 10
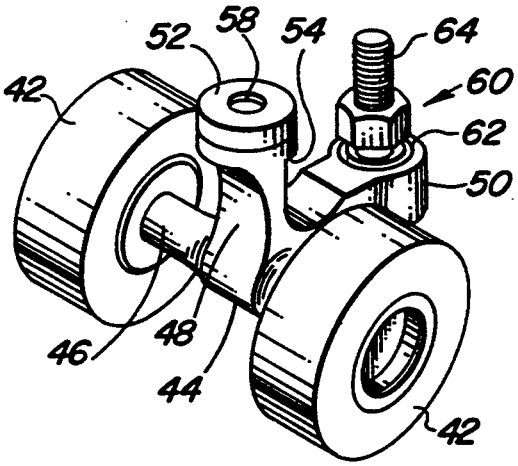
Fig. 4
Fig. 11
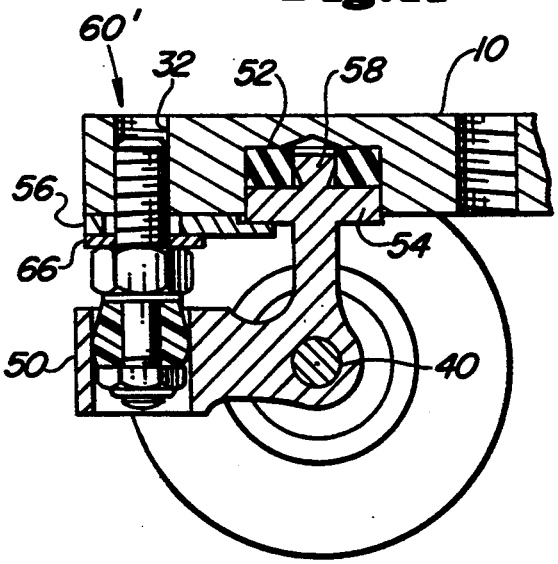

REVERSIBLE ROLLER SKATE TRUCK AND STEERING MECHANISM

TECHNICAL FIELD

This invention relates to roller skates, and more particularly to an improved roller skate truck assembly and steering mechanism.

BACKGROUND ART

Numerous roller skate designs are known in the art, all of which achieve some provision for steering the skate. This is usually accomplished by pivoting the forward and rear wheel trucks when the skater transfers his weight on the skate. Such a mechanism is taught in U.S. Pat. No. 4,623,159 issued to this inventor and hereby incorporated by reference. One difficulty with the prior art is the complexity and number of components involved in the many designs. A second problem is a failure to offer discreet and readily selectable turning rates for the wheel trucks. When the roller skate is disassembled for maintenance, it is difficult if not impossible to reassemble the skate such that the original turning rate is reestablished. This is due to the fact that turning rate is a function of the depth the king pin assembly or pivot arm is screwed into the main beam assembly of the skate. Finally, all conventional skates are turned by rotating the forward and rear wheel trucks in opposite directions. This often puts a great deal of stress and strain on the ankles, knees and hips of the skater.

DISCLOSURE OF THE INVENTION

The present invention discloses a greatly simplified roller skate with an improved means for quickly and efficiently adjusting the turning action of the skate. Front and rear wheel trucks comprising a single piece pedestal and tongue unit are engaged in cylindrical sockets formed within a main beam assembly, and are turned by selectively adjustable king pin assemblies which offer sixteen discreet turning rates for the skates in the conventional configuration. The wheel trucks may be quickly removed for maintenance by simply loosening a truck retainer nut and sliding back a truck retainer, eliminating the need to remove the entire king pin assembly. Further, a unique means for reversing the rear wheel truck is disclosed which permits the forward and rear wheel trucks to turn in the same direction, creating a "reverse-action" mode. This mode is particularly useful for speed skating and racing and also reduces the stress and strain imposed on older skaters' who may experience problems with their legs, ankles and hips, albeit with a reduction in turning capability. In this "reverse-action" skating mode, a shortened king pin is utilized which provides for eight discreet turning rates.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is a side elevation of a roller skate embodying the present invention;

FIG. 2 is a bottom plan view of the invention taken along line 2—2 of FIG. 1;

FIG. 4 is an enlarged, perspective view of a wheel truck with a king pin assembly inserted into the control cylinder of the horizontal tongue;

FIG. 5 is an enlarged, fragmentary sectional view of a wheel truck and king pin assembly with the control bushing in a first position and showing in phantom the shortened king pin with control bushing in first position engaging the reversed wheel truck;

FIG. 6 is a sectional view taken along line 6—6 of FIG. 5;

FIG. 7 is an enlarged, perspective view of a truck retainer;

FIG. 8 is an enlarged, fragmentary sectional view of a king pin assembly with the control bushing in a second position;

FIG. 9 is an enlarged, fragmentary sectional view of the end of a king pin assembly with the control bushing in a third position;

FIG. 10 is an enlarged, fragmentary sectional view of the end of a king pin assembly with the control bushing in a forth position; and FIG. 11 is an enlarged, fragmentary sectional view of the rear wheel truck in reversed position and engaged by the shortened king pin.

BEST MODE FOR CARRYING OUT THE INVENTION

Figure 3:
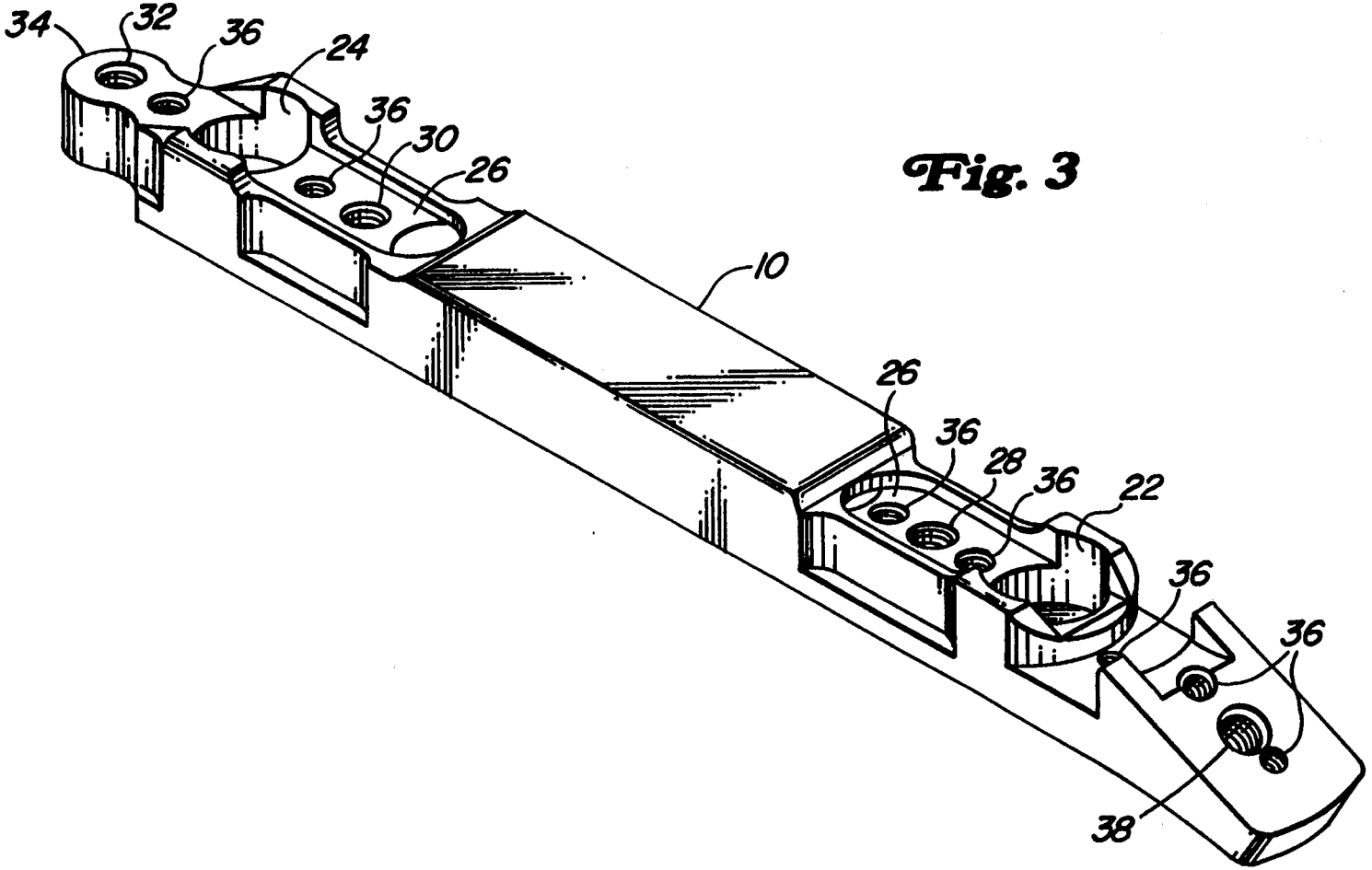
FIG. 3 is an enlarged, perspective view of the bottom of the main longitudinal beam with the trucks and king pin assemblies removed.

Referring now to the drawings, wherein like reference numerals designate identical or corresponding parts throughout the several views, a roller skate comprising the present invention is shown in FIG. 1 and includes a main longitudinal beam 10, a forward shoe support platform 12, a typical skating shoe 14, a skate brake 16, and identical front and rear wheel trucks 18, 20 respectively.

A bottom view of the main longitudinal beam 10, comprised of cast aluminum or other appropriate material, is depicted in FIG. 3 and identifies a front socket 22 and rear socket 24 formed into the beam 10. Shallow cutouts 26 extend inwardly from each of the sockets 22, 24 and have threaded king pin holes 28, 30 drilled therein. The aft end of the beam 10 further includes an extension 34 which has a third threaded king pin hole 32 drilled therein. This provides for a "reverse-action" roller skate instead of the standard roller skate when rear king pin hole 30 is utilized, as will be described below. The main beam 10 also includes a plurality of shoe mounting holes 36 as well as a brake mounting hole 38.

The front and rear wheel trucks 18, 20 are identical, and are best seen in FIG. 4 and FIG. 5. An axle 40 carries a wheel 42 on each end thereof, separated from an L-shaped truck assembly 44 by a pair of wheel spacers 46. The truck assembly 44 is a one piece casting of aluminum or other suitable material, and comprises a vertical pedestal 48 and a horizontal tongue 50 with a vertical control cylinder 62. The upper end of the pedestal 48 engages the sockets 22, 24 with the pedestal 48 serving as a column to support the main beam 10. A disk 52 of relatively hard but yieldable non-metallic material such as hard rubber, urethane, etc., is used between the top end of the pedestal 48 and the upper end of the sockets 22, 24, the arrangement and dimensioning being such that limited rocking is permitted between the skate and the axle. The pedestal 48 has opposed lips 54, slightly convex in cross-section, the inwardly directed one of which is engaged by a truck retainer 56 slightly convex on its upper surface, (see FIGS. 5, 6 and 7) and is thereby retained within the socket. The truck retainer 56 is itself secured within the shallow cutout 26 by means of a truck retainer nut 68 on king pin assembly 60 passing through an oblong aperture 80 formed in the truck retainer 56. The oblong aperture 80 permits the truck retainer 56 to slide on the king pin assembly 60 when the truck retainer nut 68 is loosened, thereby allowing the wheel trucks 18, 20 to be removed without removing the king pin assembly 60. The pedestal 48 is formed with a central protrusion 58 on its upper surface which tightly receives a central aperture formed within disk 52.

The horizontal tongue 50 of the truck assembly 44 has a control cylinder 62 formed therein which receives the downwardly extending king pin assembly 60 secured to the main beam assembly 10 by means of one of the king pin holes 28, 30, 32.

The king pin assembly 60, comprising a threaded stud 64, washer 66, truck retainer nut 68, washer 70, spacer 72, truncated pear-shaped control bushing 74, and capnut 76, also functions to retain the truck retainer 56 into position as described above. A shortened version of the king pin assembly 60' is used in the "reverse-action" mode with the rear wheel truck 20 reversed, with the spacer 72 removed. The control bushing 74 is preferably made of a hard, resilient material such as urethane. As seen in FIGS. 5, 8, 9, and 10, the spacer 72 and control bushing 74 may be interchanged in position on the stud 64, and may also be vertically rotated. This repositioning of the control bushing 74 thus creates four distinct contact areas within the control cylinder 62 of horizontal tongue 50 which provides four discreet, selectable turning rates for each wheel truck. The positioning of FIG. 5 would provide the sharpest turn rate for the skates due to the longer pivot radius of the control bushing 74, while the positioning of FIG. 10 would provide the lowest turn rate.

As mentioned previously, the main beam has an aft extension 34 providing an alternate rear king pin hole 32. This allows the rear wheel truck 20 to be reversed from the standard configuration in which the horizontal tongue 50 extends forward. See FIG. 11 and also the dotted line configuration in FIG. 5. This reversal permits both wheel trucks to pivot in the same direction when the skater's weight is shifted on the skate. To permit a turning action, it is envisioned that a shorter king pin assembly 60' without the spacer 72 would be utilized in this "reverse action" configuration. This permits a higher turning rate to be selected for the front truck 18 than for the rear truck 20, which will then still provide for some reduced turning capability. While reducing the turning action of the skate, this configuration reduces the stress and strain transmitted to the skater's ankles and legs. This mode is also more desirable in speed skating and racing where a slower turning action is important.

It should be understood that the invention will function as an improved conventional roller skate when the wheel trucks 18, 20 are positioned with their respective horizontal tongues 50 directed inward, and as a "reverse action" roller skate when the rear wheel truck 20 is reversed such that its horizontal tongue 50 is pointed rearward.

In the conventional mode, the control bushings 74 on the front and rear king pin assemblies 60 each have four discreet turning rate settings, providing a total of sixteen skate turn rates. These settings are selected by removing the capnut 76, loosening the truck retainer nut 68, sliding back the truck retainer 56, removing the truck 18, 20 and then retightening the retainer nut 68. The control bushing 74 and spacer 72 are then positioned to provide the desired turn rate for that particular truck. The capnut 76 is then replaced, the truck is replaced, the truck retainer 56 is positioned over the pedestal lip 54, and the retainer nut 68 is tightened.

In the "reverse-action" mode, the rear truck 20 is reversed by loosening the truck retainer nut 68, sliding back the truck retainer 56, and removing and reversing the truck 20. The standard king pin assembly 60 may be left in place while a shortened king pin assembly 60' and additional truck retainer 56 is screwed into king pin hole 32. Two retainers 56, each engaging a lip 54, may then be employed to secure the truck 20. This shortened king pin assembly, with the spacer removed, then has two discreet turn rate selections available, depending on the orientation of the control bushing 74. With the four discreet settings available on the front king pin assembly, there are thus eight different turn rates selectable in the "reverse-action" mode. With so many possible predetermined turning actions available, a selection chart is useful to help skaters find the right turning action for their needs and to keep a record of previous settings and preferences.

While the invention has been described with a certain degree of particularity, it is manifest that many changes may be made in the details construction and the arrangement of the components without departing from the spirit and scope of the disclosure. It is therefore to be understood that the invention is not limited to the embodiment set forth herein for purposes of exemplification, but is to be limited only by the scope of the appended claims, including the full range of equivalency to which each element thereof is entitled.

I claim:

1. A roller skate, comprising:

(a) a main longitudinal beam having a front end and a rear end and an upper surface and a lower surface, and having a front socket and a rear socket formed in said lower surface;

(b) a front wheel truck and a rear wheel truck, each of said trucks having an axle with a wheel rotatably mounted on each end thereof, a vertical pedestal extending from each respective axle to within said front and rear socket, and a horizontal tongue having a control cylinder therein;

(c) a front king pin assembly and a rear king pin assembly, said king pin assemblies removably extending from said lower surface of said main beam and engaging said control cylinders, said king pin assemblies comprising a reversible control bushing and a spacer interchangeably mounted on a threaded stud; and (d) a truck retainer, secured to said lower surface by said king pin assembly, protruding upon and engaging a portion of said pedestal to retain said pedestal within said socket.

2. The roller skate of claim 1, wherein said control bushing has a truncated pear shape.

3. The roller skate of claim 2, wherein said vertical pedestal, said horizontal tongue and said control cylinder comprise a single piece of cast aluminum.

4. The roller skate of claim 3 wherein said rear wheel truck is reversible.

* * * * *